US008586271B2

(12) United States Patent
Asarese et al.

(10) Patent No.: US 8,586,271 B2
(45) Date of Patent: Nov. 19, 2013

(54) TONER COMPOSITION HAVING DUAL WAX

(75) Inventors: Daniel W Asarese, Honeoye Falls, NY (US); Grazyna E Kmiecik-Lawrynowicz, Fairport, NY (US); Eugene F Young, Rochester, NY (US); William H Hollenbaugh, Jr., Rochester, NY (US); Eunhee Lee, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/413,534

(22) Filed: Mar. 6, 2012

(65) Prior Publication Data

US 2012/0225378 A1 Sep. 6, 2012

Related U.S. Application Data

(63) Continuation of application No. 11/411,499, filed on Apr. 25, 2006, now abandoned.

(51) Int. Cl.
*G03G 9/08* (2006.01)

(52) U.S. Cl.
USPC ..... 430/108.1; 430/108.8

(58) Field of Classification Search
USPC ..... 430/108.1, 108.8
See application file for complete search history.

(56) References Cited

U.S. PATENT DOCUMENTS

| | | | | |
|---|---|---|---|---|
| 5,344,737 | A * | 9/1994 | Berkes et al. | 430/108.8 |
| 5,605,778 | A | 2/1997 | Onuma et al. | |
| H1889 | H | 10/2000 | Lin | |
| 6,156,469 | A | 12/2000 | Sato | |
| 6,500,595 | B1 | 12/2002 | Mochizuki | |
| 6,808,851 | B2 | 10/2004 | Bartel | |
| 2003/0044708 | A1 | 3/2003 | Matsunaga | |
| 2003/0232268 | A1 * | 12/2003 | Sacripante et al. | 430/137.14 |
| 2004/0137357 | A1 | 7/2004 | Bartel | |
| 2005/0208409 | A1 | 9/2005 | Yasumatsu | |
| 2005/0266332 | A1 | 12/2005 | Pavlisco | |
| 2006/0228639 | A1 | 10/2006 | Young | |

FOREIGN PATENT DOCUMENTS

| | | |
|---|---|---|
| JP | 2004070016 | 3/2004 |

* cited by examiner

*Primary Examiner* — Hoa V Le
(74) *Attorney, Agent, or Firm* — MDIP LLC

(57) ABSTRACT

Included is an emulsion aggregation toner formulation having at least one latex and a combination of at least two waxes, wherein one wax is a synthetic wax, and another wax is a natural wax, and further including a developer containing a carrier and the just-described toner.

19 Claims, No Drawings

TONER COMPOSITION HAVING DUAL WAX

BACKGROUND

The present disclosure relates generally to toner and developer compositions, useful in electrostatographic, electrophotographic, xerographic, and the like machines, including printers, copiers, scanners, facsimiles, and the like, and including digital and image-on-image machines. More specifically, the disclosure relates to toner compositions comprising-dual wax combination. In embodiments, the dual wax combination comprises a polyethylene wax in combination with a Carnauba wax.

Methods of preparing emulsion aggregation (EA) type toner are known. Toners may be formed by aggregating a colorant with a latex polymer formed by batch or semi-continuous emulsion polymerization. For example, U.S. Pat. No. 5,853,943, the disclosure of which is hereby incorporated by reference in its entirety, discloses a semi-continuous emulsion polymerization process for preparing a latex by first forming a seed polymer. In particular, the '943 patent describes a process comprising: (a) conducting a pre-reaction monomer emulsification comprising emulsification of the polymerization reagents of monomers, chain transfer agent, a disulfonate surfactant or surfactants, and optionally, an initiator, wherein the emulsification is accomplished at a low temperature of, for example, from about 5° C. to about 40° C.; (b) preparing a seed particle latex by aqueous emulsion polymerization of a mixture comprising (i) part of the monomer emulsion, for example, from about 0.5 to about 50 percent by weight, or from about 3 to about 25 percent by weight, of the monomer emulsion prepared in (a), and (ii) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprising latex resin wherein the particles are stabilized by surfactants; (c) heating and feed adding to the formed seed particles the remaining monomer emulsion, from about 50 to about 99.5 percent by weight, or from about 75 to about 97 percent by weight, of the monomer emulsion prepared in (b), and optionally a free radical initiator, from about 0 to about 99.5 percent by weight, or from about 0 to about 97 percent by weight, of the total initiator used to prepare the latex polymer at a temperature from about 35° C. to about 125° C.; and (d) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Currently, some known EA toner formulations use a single wax (for example, polyolefin, such as polyethylene or polypropylene). The present disclosure describes the replacement of the use of a single polyolefin with a combination of synthetic and a second, different wax. The use of the combination of different waxes is believed to increase the release function of the EA toner. The result is ease of cleaning of the photoreceptor. In addition, polyolefin waxes are expensive. Therefore, by cutting back on the amount of wax by using a combination of two different waxes, an EA toner can be produced at a lower cost.

Toner builds up on the thermister, striper fingers and the cleaning web. This toner deposits itself on the back of copies. The dual wax formulation allows greater release properties and a more uniform distribution of surface additives and consequently a more uniform charge distribution on the surface of the toner. This eliminates or minimizes toner deposits on the stripper fingers, thermister, and cleaning web.

Therefore, it is desirable to provide a toner which solves or reduces fusing defects. It is further desired to provide an EA toner that can be prepared with less wax, in order to decrease the cost of production of the EA toner. The lower amount of total wax yields less wax on the toner surface. This allows lower amounts of external toner additives to be used and lowers the cost. Less wax on the surface also facilitates increased toner flow and a more uniformed surface charge. The lower melting wax would allow faster copier speeds and/or lower fusing temperatures.

SUMMARY

Embodiments include an emulsion aggregation toner formulation comprising a binder resin and a combination of a first and second wax, wherein the first wax is a synthetic wax, and the second wax is a natural wax.

Embodiments also include an emulsion aggregation toner formulation comprising a binder resin, colorant, and a combination of a first and second wax, wherein the first wax is synthetic wax, and the second wax is a natural wax, and wherein the first and second wax are present in said emulsion aggregation toner formulation in a weight ratio of from about 40/60 to about 60/40.

Further, embodiments include an emulsion aggregation toner formulation comprising a binder resin, colorant, and a combination of a first and second wax, wherein the first wax is a polyethylene wax having a Mw of from about 700 to about 750, and having a degree of crystallinity as calculated by heat of melting and as measured by DSC of from about 55 to about 100 percent, and the second wax is a Carnauba wax, and wherein said first and second wax are present in the emulsion aggregation toner formulation in a weight ratio of from about 40/60 to about 60/40.

In addition, embodiments include a developer including a carrier and an emulsion aggregation toner formulation comprising a binder resin and a combination of a first and second wax, wherein the first wax is a synthetic wax, and the second wax is a natural wax.

DETAILED DESCRIPTION

In embodiments, the toner is an emulsion aggregation type toner prepared by the aggregation and fusion of latex resin particles with a colorant.

In embodiments, the latex which may be used in forming toner includes, for example, submicron non-crosslinked resin particles in the size range of, for example, from about 50 to about 500 nanometers, or from about 100 to about 400 nanometers in volume average diameter as determined, for example, by a Brookhaven nanosize particle analyzer. The non-crosslinked resin is generally present in the toner composition of from about 75 to about 98, or from about 80 to about 95 weight percent of the toner or the solids of the toner. The expression "solids" can refer to the latex, colorant, wax, and any other optional additives in the toner composition.

One or more additives may be included such as surfactants, coagulants, waxes, surface additives, and optionally mixtures thereof. In embodiments, one or more is from about 1 to about 20 or from about 3 to about 10.

In embodiments, the non-crosslinked resin in the latex is derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA), polyesters, and the like, and mixtures thereof.

In embodiments, the non-crosslinked resin of the latex may include at least one polymer. Exemplary polymers includes styrene acrylates, styrene butadienes, styrene methacrylates, and more specifically, poly(styrene-alkyl acrylate), poly(styrene-1,3-diene); poly(styrene-alkyl methacrylate), poly(styrene-alkyl acrylate-acrylic acid), polystyrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), polystyrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. In embodiments, the polymer is polystyrene/butyl acrylate/beta carboxyl ethyl acrylate). The polymer may be block, random, or alternating copolymers.

In embodiments, the latex may be prepared by a batch or a semicontinuous polymerization resulting in submicron non-crosslinked resin particles suspended in an aqueous phase containing a surfactant. Examples of suitable surfactants include ionic or nonionic surfactants in an amount of from about 0.01 to about 15, or from about 0.01 to about 5 weight percent of total solids.

Anionic surfactants include sulfates and sulfonates such as sodium dodecylsulfate (SDS), sodium dodecyl benzene sulfonate, sodium dodecylnaphthalene sulfate, dialkyl benzene-alkyl sulfates and sulfonates, abitic acid, and the NEOGEN® brand of anionic surfactants. In embodiments a suitable anionic surfactant is NEOGEN® RK available from Daiichi Kogyo Seiyaku Co. Ltd., or TAYCA POWER® BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL® and ALKAQUAT® available from Alkaril Chemical Company, SANISOL® (benzalkonium chloride), available from Kao Chemicals, and the like. In embodiments, a suitable cationic surfactant includes SANISOL® B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonyiphenyl ether, dialkylphenoxy poly (ethyleneoxy) ethanol available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. In embodiments a suitable nonionic surfactant is ANTAROX 897® available from Rhone-Poulenc Inc., which is primarily an alkyl phenol ethoxylate.

In embodiments, the non-crosslinked resin may be prepared with initiators, such as water-soluble initiators and organic soluble initiators. Exemplary water-soluble initiators are ammonium and potassium persulfates. These can be added in suitable amounts, such as from about 0.1 to about 8, or from about 0.2 to about 5 weight percent of the monomer. Examples of organic soluble initiators include Vazo peroxides, such as Vazo 64, 2-methyl 2-2'-azobis propanenitrile, and Vazo 88, 2-2'-azobis isobutyramide dehydrate in a suitable amount, such as from about 0.1 to about 8, or from about 0.2 to about 5 weight percent of the monomer.

Known chain transfer agents can also be used to control the molecular weight properties of the resin if prepared by emulsion polymerization. Examples of chain transfer agents include dodecane thiol, dodecylmercaptan, octane thiol, carbon tetrabromide, carbon tetrachloride and the like, in various suitable amounts, such as from about 0.1 to about 20, or from about 0.2 to about 10 percent by weight of monomer.

Resin particles may also be produced by a polymer microsuspension process as disclosed in U.S. Pat. No. 3,674,736, polymer solution microsuspension process as disclosed in U.S. Pat. No. 5,290,654, the disclosure of both of these references is hereby incorporated by reference in their entirety, mechanical grinding processes, or other known processes.

In embodiments, gel latex may be added to the non-crosslinked latex resin suspended in the surfactant. Gel latex may refer in embodiments, to a crosslinked resin or polymer, or mixtures thereof, or a non-crosslinked resin as described above, that has been subjected to crosslinking.

The gel latex may include, submicron crosslinked resin particles having a size of from about 10 to about 200, or from about 20 to 100 nanometers in volume average diameter. The gel latex may be suspended in an aqueous phase of water containing a surfactant, wherein the surfactant can be in an amount from about 0.5 to about 5, or from about 0.7 to about 2 percent by weight of total solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), polystyrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25, or from about 0.5 to about 15 percent by weight of the crosslinked resin.

The crosslinked resin particles may be present in an amount of from about 0.1 to about 50, or from about 1 to about 20 percent by weight of the toner.

In embodiments, the gel latex may be a mixture of a crosslinked resin and a non-crosslinked resin.

Optionally, a second latex can be added to the aggregated particles. The second latex may include, for example, submicron non-crosslinked resin particles. The second latex may be added in an amount of from about 10 to about 40 percent by weight of the initial latex, and in embodiments in an amount of from about 15 to about 30 percent by weight of the initial latex, to form a shell or coating on the toner aggregates wherein the thickness of the shell is from about 200 to about 800 nanometers, and in embodiments from about 250 to about 750 nanometers.

In embodiments of the present disclosure, the latex and the second latex may be the same non-crosslinked resin.

In embodiments, the core latex and the second shell latex may be different non-crosslinked resins.

The core, shell latexes and optional gel latex may be added to a colorant and/or a wax to form a toner. In embodiments, the colorant may be in a dispersion and the wax may also be in a dispersion. The colorant dispersion includes, for example, submicron colorant particles having a size of, from about 50 to about 500, or from about 100 to about 400 nanometers in volume average diameter. The colorant particles may be suspended in an aqueous water phase containing an anionic surfactant, a nonionic surfactant, or mixtures thereof. In embodiments, the surfactant may be ionic and is from about 1 to about 25, or from about 4 to about 15 percent by weight of the colorant.

Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B® type, red, green, orange, brown, violet, yellow, fluorescent colorants, and the like.

The colorant may be present in the toner in an amount of from about 1 to about 25, or from about 2 to about 15 percent by weight of the toner.

Exemplary colorants include carbon black like REGAL 330® magnetites; Mobay magnetites including MO8029®, MO8060®; Columbian magnetites; MAPICO BLACKS® and surface treated magnetites; Pfizer magnetites including CB4799®, CB5300®, CB5600®, MCX6369®; Bayer magnetites including, BAYFERROX 8600®, 8610®; Northern Pigments magnetites including, NP-604®, NP-608®; Magnox magnetites including TMB-100®, or TMB-104®, HELIOGEN BLUE L6900®, D6840®, D7080®, D7020®, PYLAM OIL BLUE®, PYLAM OIL YELLOW®, PIGMENT BLUE 1® available from Paul Uhlich and Company, Inc.; PIGMENT VIOLET 1®, PIGMENT RED 48®, LEMON CHROME YELLOW DCC 1026®, E.D. TOLUIDINE RED® and BON RED C® available from Dominion Color Corporation, Ltd., Toronto, Ontario; NOVAPERM YELLOW FGL®, HOSTAPERM PINK E® from Hoechst; and CINQUASIA MAGENTA® available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be used include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20, or from about 5 to about 20 weight percent of the toner.

The toner may also include any known charge additives in amounts of from about 0.1 to about 10, or from about 0.5 to about 7 weight percent of the toner.

Where used, wax dispersions include submicron wax particles having a size of from about 50 to about 500 or from about 100 to about 400 nanometers in volume average diameter, suspended in an aqueous phase of water and an ionic surfactant, nonionic surfactant, or mixtures thereof. The ionic surfactant or nonionic surfactant may be present in an amount of from about 0.01 to about 10, or from about 0.2 to about 5 percent by weight of the wax.

In embodiments, a combination of two different waxes is used in the EA toner formulation herein. Examples of suitable release agents or waxes include natural vegetal wax, natural animal wax, mineral wax and/or synthetic wax. The term "natural vegetal wax" means a wax that occurs in its natural form and having originates from a variety of different plants, and is not synthetic. Examples of natural vegetal waxes include, for example, Carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof. Other examples of waxes include polyolefins such as polypropylenes, polyethylenes, and the like, such as those commercially available from Allied Chemical and Baker Petrolite COrporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K.K., and similar materials. Examples of functionalized waxes include amines, amides, for example Aqua Superslip 6550™, Superslip 6530™ available from Micro Powder Inc.; fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc.; mixed fluorinated, amide waxes, for example Microspersion 19™ also available from Micro Powder Inc.; imides, esters, quatemary amines, carboxylic acids or acrylic polymer emulsion, for example Joncryl 74™, 89™, 130™, 537™, and 538™, all available from SC Johnson Wax; chlorinated polypropylenes and polyethylenes available from Allied Chemical and Petrolite Corporation, and from SC Johnson Wax. Example of an ester wax would be Licowax F™ available from Clariant Corporation. Such waxes can optionally be fractionated or distilled to provide specific cuts that meet viscosity and/or temperature criteria wherein the upper limit of viscosity is 10,000 cps and the temperature upper limit is 120° C.

In embodiments, the wax comprises a wax in the form of a dispersion comprising, for example, a wax having a particle diameter of about 100 nanometers to about 500 nanometers or about 100 nanometers to about 300 nanometers, water, and an anionic surfactant or a polymeric stabilize, and optionally a nonionic surfactant. In embodiments, the wax comprises polyethylene wax particles, such as POLYWAX® 655, POLYWAX® 850, POLYWAX® 725, POLYWAX® 500, POLYWAX® 400 (the POLYWAX® waxes being commercially available from Baker Petrolite) and, for example, fractionated/distilled waxes which are cuts of commercial POLYWAX® 655 designated here as X1214, X1240, X1242, X1244, and the like, but are not limited to POLYWAX® 655 cuts. The surfactant used to disperse the wax can be an anionic surfactant, although not limited thereto, such as, for example, Neogen RK® commercially available from Daiichi Kogyo Seiyaku or TAYCAPOWER® BN2060 commercially available from Tayca Corporation or Dowfax available from DuPont.

In embodiments, at least one of the waxes has a degree of crystallinity (Xc) as calculated by heat of melting or heat of fusion or enthalpy, and as measured by DSC, of from about 55 to about 100 percent, or from about 60 to about 98 percent, or from about 70 to about 95 percent, or from about 75 to about 90 percent.

The melt viscosity of the wax for example at 92° C., is less than or about 10,000 centipoise, or from about 5 to about 10,000 centipoise, and the viscosity at 110° C. is less than or equal to 100 centipoise, or from about 1 to about 100 centipoise, irrespective of the heating or the melting cycle. Furthermore the useful temperature for coalescence/fusion step can be lower than 92° C., for example as low as 88° C.

In embodiments, the natural wax has an onset temperature of from about 40 to about 70° C., and an offset temperature of from about 70 to about 90° C., during the heat up cycle (i.e., melting), as measured by a DSC when the heating rate is 10° C./min.

In embodiments, the synthetic wax has an onset melt temperature of from about 65 to about 75° C., and an offset temperature of from about 95 to about 100° C.

In embodiments, the synthetic wax has a Mn, and each and all may fall within the ranges of from about 400 to about 850 or from about 650 to about 800 or from about 700 to about 750, or about 725.

The total wax combination in a toner material is, for example, in an amount of about 1 to about 20 percent, or from about 2 to about 15 percent by weight based upon the total weight of the composition.

In embodiments, a combination of different waxes can be used. In embodiments, a synthetic and a natural wax are used together. In embodiments, a combination of a polyolefin wax and Carnauba wax are used. In specific embodiments, the wax combination comprises a polyethylene wax and Carnauba wax.

In embodiments, the first and second waxes are present in weight ratios of from about 40/60 to about 60/40, or from about 58/42 to about 42/58, or from about 55/45 to about 45/55, or about 50/50. In embodiments, a polyethylene (such as Polywax 655, 725, or the like) and a natural vegetal wax, such as Carnauba wax, are used in approximately a 50/50 weight ratio, although any of the above ratios can be used.

The resultant blend of latex dispersion, optional gel latex dispersion, colorant dispersion, and wax dispersion may be stirred and heated to a temperature of from about 45° C. to about 65° C., in embodiments of from about 48° C. to about 63° C., resulting in toner aggregates of from about 4 to about 8, or from about 5 microns to about 7 microns in volume average diameter.

In embodiments, a coagulant may be added during or prior to aggregating the latex, the aqueous colorant dispersion, the wax dispersion and the optional gel latex. The coagulant may be added over a period of time from about 1 to about 5 or from about 1.25 to about 3 minutes. The time above is lab scale; this would be different in manufacturing.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 0.3 percent by weight of the toner, and in embodiments from about 0.05 to about 0.2 percent by weight of the toner.

Once the desired final size of the particles is achieved with a volume average diameter of from about 4 to about 9 microns, or from about 5.6 to about 8 microns, the pH of the mixture may be adjusted with a base to a value of from about 4 to about 7, or from about 6 to about 6.8. The base may include any suitable base such as, alkali metal hydroxides including sodium hydroxide, potassium hydroxide, and ammonium hydroxide. The alkali metal hydroxide may be added in amounts from about 6 to about 25 or from about 10 to about 20 percent by weight of the mixture.

The pH of the mixture is then lowered to from about 6.5 to about 3.0, or from about 6.0 to about 3.5 with, for example, an acid to protonate and better coalesce the toner aggregates. Suitable acids include nitric acid, sulfuric acid, hydrochloric acid, citric acid, or acetic acid. The amount of acid added may be from about 4 to about 30 or from about 5 to about 15 percent by weight of the mixture. The mixture temperature may be from 70° C. to about 93° C., or from 75° C. to about 87° C.

The mixture is subsequently coalesced. Coalescing may include stirring and heating at a temperature of from about 90° C. to about 99° C., for a period of from about 0.5 to about 6, or from about 2 to about 5 hours.

The pH of the mixture may be adjusted with a base to a value of from about 3.5 to about 7, or from about 3.7 to about 6.0. The base may include any suitable base such as, alkali metal hydroxides including sodium hydroxide, potassium hydroxide, and ammonium hydroxide.

The mixture is then cooled. Cooling may be at a temperature of from about 20° C. to about 40° C., or from about 22° C. to about 30° C. over a period time from about 1 to about 8, or from about 1.5 to about 5 hours.

The toner in the mixture is then recovered via wet sieving or filtering the mixture and the coalesced particles thereby obtained are washed and dried. The washing includes filtering and reslurrying a filter cake. The pH of the mixture is adjusted to from about 3 to about 7, or from about 4 to about 6. Typically, the pH is adjusted with a base such as sodium hydroxide, ammonia hydroxide, or the like. In embodiments, the base is added to a heated emulsion aggregation toner. The emulsion aggregation toner may be heated to a temperature of from about 40° C. to about 80° C., or from about 50° C. to about 70° C. Once the desired pH has been obtained, the slurry is sieved and the mother liquor decanted. In embodiments, the wet cake toner is then reslurried in clean, deionized or distilled water, typically having a pH of from about 6 to about 10, or from about 7 to about 9. The mixture is then filtered, and the resulting filter cake is washed one or more times with deionized or distilled water. The pH may be reduced with an acid such as HCl, $HNO_3$ or other similar types during the washing with deionized water or distilled water. The acid may reduce the pH to from about 8 to about 3, or from about 6 to about 3.5. The washing with deionized distilled water may be at a temperature of from about 30° C. to about 70° C., and in embodiments from about 35° C. to about 55° C.

In embodiments, the pH of coalesced toner slurry is adjusted with a base to about 10, followed by one or more deionized water or distilled water washes. During the deionized or distilled water wash, the pH of the slurry is adjusted with an acid to about 4. In embodiments, three washes with deionized or distilled water may be used. In embodiments, the pH of the slurry is adjusted with an acid during the second wash.

Drying of the toner is typically carried out at a temperature of from about 35° C. to about 75° C., or from about 45° C. to about 60° C. for a period of time from about 1 to about 10 hours, or from about 2 to about 4 hours. The drying may be continued until the moisture level of the particles is below a set target of less than about 1% by weight or less than about 0.5% by weight.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10, or from about 0.5 to about 7 weight percent of the toner. Example of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5, or from about 0.1 to about 2 percent of the toner, which additives can be added during the aggregation or blended into the formed toner product.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20, or from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

The toner described herein can also be used in single component development, and in non-magnetic development.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners. Development can also be charged-area development.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Emulsion aggregation toner was prepared as follows. A toner slurry was prepared by combining a latex dispersion, a 50/50 mixture of Polywax® 725 and Carnauba wax, a latex, and a colorant dispersion Regal 330 carbon black. Specifically, 596.6 grams of distilled water, 265.8 grams core latex (41.4% solids, Tg=59.4° C., Mw=36.6 k, size=223 nm), 97.9 grams gel latex (10% solids), and 126.1 grams pigment (17.0% solids). The mixture was placed in a 2-liter reactor set at 20° C. The materials were homogenized for 30 seconds at 4,000 rpm. While homogenizing, 93.74 grams of the wax combination (30% solids) was added over 30 seconds. After 1 minute, about 42.5 grams of a 10% solution of polyaluminum chloride was added over 3 minutes. Homogenization continued for 20 minutes. The homogenizer was replaced with a single A200 impeller, and the mixing continued at 300 RPM. The reactor was set to 59° C., and the particle size was monitored. When the particle size reached 4.5 microns, 173.1 grams of shell latex (41.4% solids, Tg=59.4° C., Mw=36.6 k, size=223 nm) was added over 11 minutes. When the particle size reached 5.9 microns, the mixture was subjected to freeze reaction with a 4% NaOH solution. The particles were then coalesced at 96° C., washed, and then dried.

The particle formulation was as follows: 8% pigment, 43% core latex, 28% shell latex, 10% gel latex, 0.17 pph poly aluminum chloride, and 6% wax combination of the dry toner.

All particles were made using the above procedure and the formulation was adjusted for lower wax levels. The above procedure produced the following particles of Table 1.

TABLE 1

| Toner No. | Shimadzu MF (140° C. 10 kg) (G/10 min) | (MI 130° C.)/ 16.6 kg) (G/10 min) | Shape factor (circularity) | Particle Size (vol.) | Distribution (vol. 84/50) | Distribution (num 50/16) | Tg Onset (° C.) | Molecular Weight (Kpse) | BET ($m^2/g$) | Total Wax (%) |
|---|---|---|---|---|---|---|---|---|---|---|
| 194 (control) | 17.6 | 32.3 | 0.965 | 5.70 | 1.20 | 1.24 | 57.4 | 36.6 | 1.63 | 11.0 |
| 195 | 32.6 | 59.0 | 0.977 | 5.70 | 1.19 | 1.27 | 54.6 | 34.1 | 1.74 | 8.8 |
| 197 | 22.0 | 37.6 | 0.978 | 5.62 | 1.18 | 1.23 | 53.2 | 35.8 | 1.43 | 4.8 |
| 201 | 27.5 | 45.5 | 0.979 | 5.82 | 1.19 | 1.23 | 53.3 | 34.1 | 1.42 | 7.4 |
| 203 | 25.4 | 30.7 | 0.979 | 5.89 | 1.19 | 1.23 | 54.8 | 34.6 | 1.27 | 3.3 |

Sample 194 is a control and contains only the synthetic wax.

The combination of two different types of wax was incorporated into parent particles at an 11% nominal level, 8% level, 6% level and 4% level by weight. Using a 2-liter glass reactor, the lab scale EA formulation black parent particles were aggregated, coalesced, washed, and then freeze dried.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An emulsion aggregation toner comprising at least one latex and a combination of at least two waxes, wherein a first of said at least two waxes comprises a synthetic wax comprising an Mn of from about 400 to about 850, and a second of said at least two waxes comprises a natural wax; wherein said first wax and said second wax are in a weight ratio of from about 60/40 to about 40/60; and wherein said toner comprises a melt flow at 140° C. with a 10 kg weight in 10 minutes greater than melt flow of a similar toner but comprising only said synthetic wax.

2. The emulsion aggregation toner as claimed in claim 1, comprising any combination of a synthetic and/or a natural wax.

3. The emulsion aggregation toner as claimed in claim 1, wherein said synthetic wax comprises a polyolefin wax.

4. The emulsion aggregation toner as claimed in claim 1, wherein said synthetic wax is selected from the group consisting of polyethylenes and polypropylenes.

5. The emulsion aggregation toner as claimed in claim 1, wherein said synthetic wax comprises a polyethylene.

6. The emulsion aggregation toner as claimed in claim 1, wherein said natural wax comprises a natural vegetal wax.

7. The emulsion aggregation toner as claimed in claim 1, wherein said natural wax is selected from the group consisting of Carnauba wax, candelilla wax, Japan wax, and bayberry wax.

8. The emulsion aggregation toner as claimed in claim 1, wherein said natural wax comprises a Carnauba wax.

9. The emulsion aggregation toner as claimed in claim 1, comprising two waxes.

10. The emulsion aggregation toner as claimed in claim 1, wherein said weight ratio is from about 58/42 to about 42/58.

11. The emulsion aggregation toner as claimed in claim 1, wherein said weight ratio is from about 55/45 to about 45/55.

12. The emulsion aggregation toner as claimed in claim 1, wherein said at least two waxes comprise at least one of the following:

a. degree of crystallinity of from about 55% to about 100%;
b. melt viscosity at 92° C. of about 10,000 centipoise of less;
c. viscosity at 110° C. of from about 1 to about 100 centipoise; and
d. onset temperature of the natural wax of from about 40° C. to about 70° C.

13. The emulsion aggregation toner as claimed in claim 1, wherein said Mn is from about 650 to about 800.

14. The emulsion aggregation toner as claimed in claim 1, wherein said Mn is from about 700 to about 750.

15. The emulsion aggregation toner as claimed in claim 1, wherein said at least one latex comprises a core latex and a shell latex.

16. The emulsion aggregation toner as claimed in claim 1, wherein said at least one latex comprises a core latex, a shell latex, and a gel latex.

17. A developer composition comprising a carrier and the emulsion aggregation toner of claim 1.

18. An emulsion aggregation toner comprising at least one latex, a colorant, and a combination of at least two waxes, Wherein a first wax comprises a polyolefin wax comprising an Mn of from 400 to about 850, and a second wax comprises a natural vegetal wax, wherein said polyolefin wax and said natural vegetal wax are present in a weight ratio of from about 40/60 to about 60/40 and wherein said toner comprises a melt flow at 140° C. with a 10 kg weight in 10 minutes greater than melt flow of a similar toner but comprising only said polyolefin wax.

19. An emulsion aggregation toner comprising a core latex, a shell latex, a gel latex, a colorant, and a combination of at least two waxes, wherein a first wax comprises a polyethylene wax comprising an Mn of from about 700 to about 750, and a second wax comprises a Carnauba wax, wherein said polyethylene wax and said Carnauba wax are present in a weight ratio of from about 40/60 to about 60/40 and wherein said toner comprises a melt flow at 140° C. with a 10 kg weight in 10 minutes greater than melt flow of a similar toner but comprising only said polyethylene wax.

* * * * *